United States Patent [19]

Seiford, Sr.

[11] Patent Number: 4,926,755

[45] Date of Patent: May 22, 1990

[54] RAIL CAR MOVING SYSTEM

[75] Inventor: Donald S. Seiford, Sr., Inver Gr. Hts, Minn.

[73] Assignee: DS Industrial & Marine Co., Inc., Newport, Minn.

[21] Appl. No.: 290,138

[22] Filed: Dec. 27, 1988

[51] Int. Cl.[5] ..... B61B 13/12; B61J 3/06; B61J 3/08

[52] U.S. Cl. ..... 104/183; 104/162; 104/176

[58] Field of Search ..... 104/162, 183, 176

[56] References Cited

U.S. PATENT DOCUMENTS 2,900,922 8/1959 Edmonds ..... 104/162
3,508,499 4/1970 Collins ..... 104/176

FOREIGN PATENT DOCUMENTS 2920790 12/1980 Fed. Rep. of Germany ..... 104/176
230720 8/1969 U.S.S.R. ..... 104/162

*Primary Examiner*—Andres Kashnikow
*Assistant Examiner*—Virna Lissi Mojica
*Attorney, Agent, or Firm*—The Firm of Edwin E. Greigg

[57] ABSTRACT

A rail car moving system including a double truck assembly which is operative in a guide track alongside the rail track for applying a pushing force to a rail car. The double truck assembly includes pusher arms which are movable from a recessed position to a raised position in order to apply a force onto the side frame of a rail car. The pusher arms are spring loaded for raising the arms and a hydraulic cylinder-piston is provided to lower the pusher arms. A cable-winch is used for applying the moving force.

9 Claims, 3 Drawing Sheets

RAIL CAR MOVING SYSTEM

BACKGROUND OF THE INVENTION

This invention is directed to a system for moving rail cars and more specifically to rail cars moving system which is useful over a short distance.

OBJECT AND SUMMARY OF THE INVENTION

Heretofore rail cars have been moved from place to place by a device as set forth in U.S. Pat. No. 3,377,961 as well as by use of engines or other driven devices which include hooks and other connecting devices which required manual operation of the devices. Further cable moving systems have been used where the cable was physically connected to a car and the car or cars touch thereby.

This invention sets forth a rail car moving device which requires no hooks or connecting parts between the rail car to be moved and the moving system.

It is therefore an object of the invention to provide a rail car moving system which is substantially automatic for moving rail cars in either direction at a controlled speed. That will retard, stop and reverse the direction of the movement of the cars.

Another object is to provide a rail car moving sytem which is easy to install and which will not interfere with normal operation of a rail car along the moving system when not in use.

Yet another object is to provide a rail car moving sytem which is useful for moving box cars, hopper cars, gondolas, tank cars, etc.

Still another object is to provide a rail car moving sytem which is relatively inexpensive and simple to operate.

The invention will be better understood and further objects and advantages thereof will become more apparent from the ensuing detailed description of preferred embodiments taken in conjunction with the drawings.

DETAILED DESCRIPTION

Figure 1:
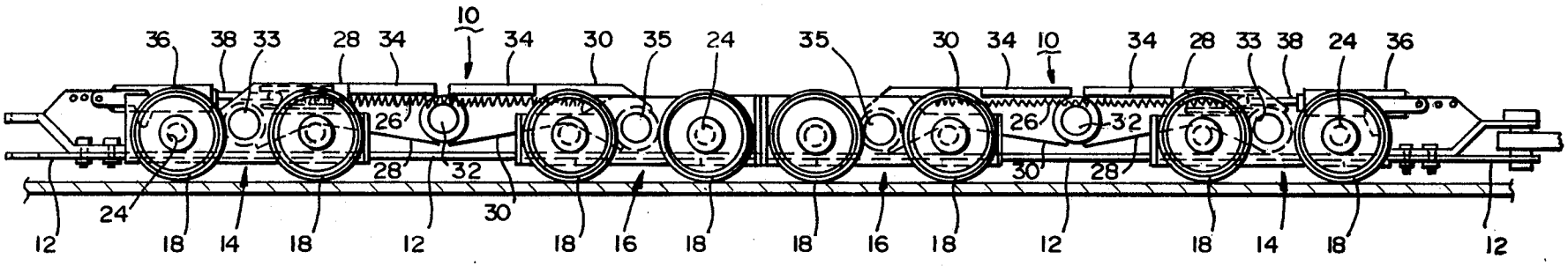
FIG. 1 illustrates a side view of a rail car moving system having double shuttle drive cars, shown in their non use position.
Figure 2:
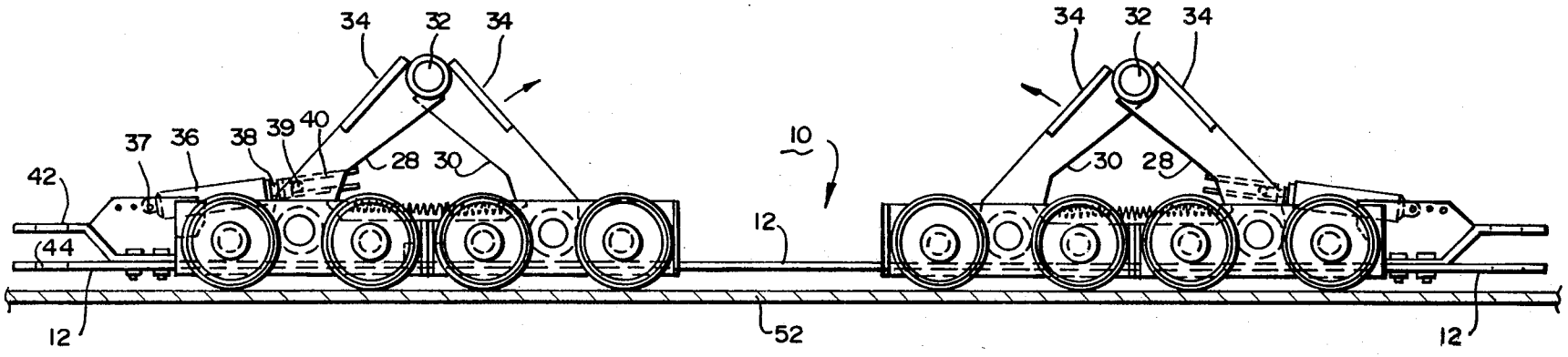
FIG. 2 illustrates a side view of the rail car moving system as shown in FIG. 1 in its rail car moving position.
Figure 3:
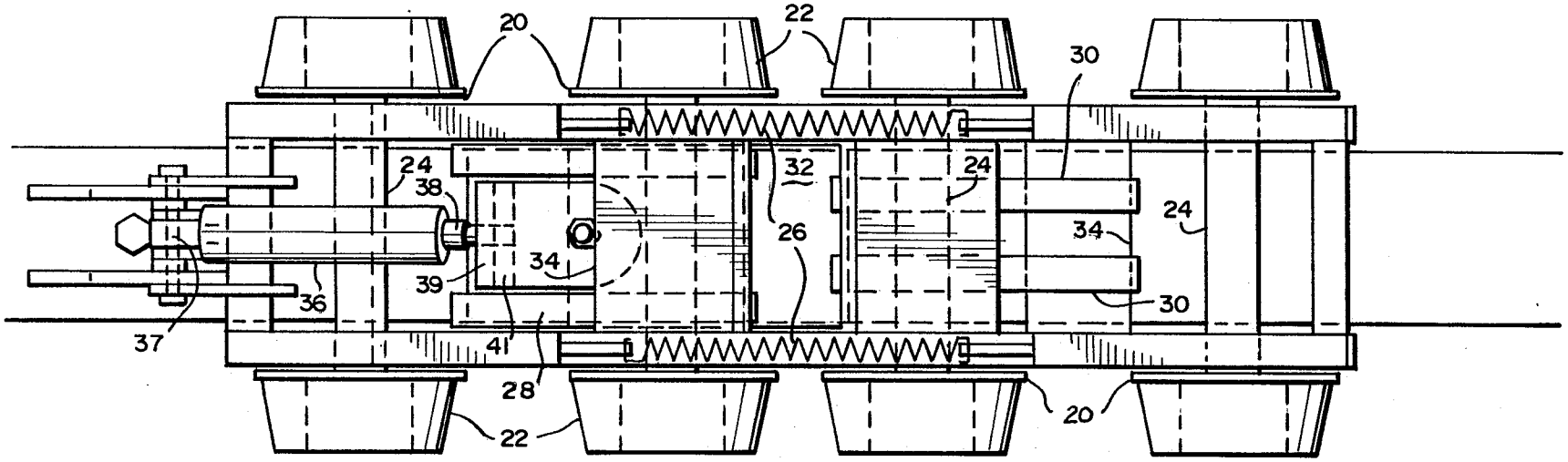
FIG. 3 is a top view of the rail car mover system.
Figure 4:
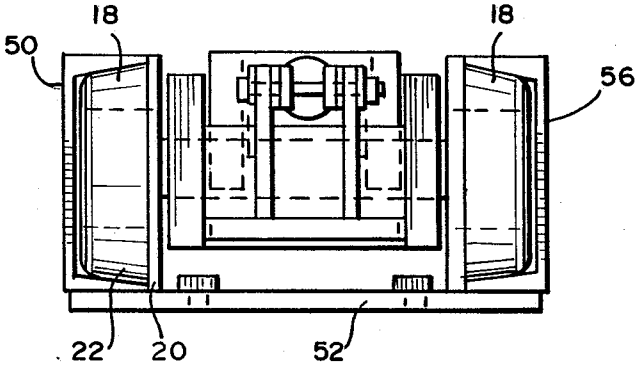
FIG. 4 is an end view illustrating the guide tracks and wheel shape of the rail car drive system.
Figure 5:
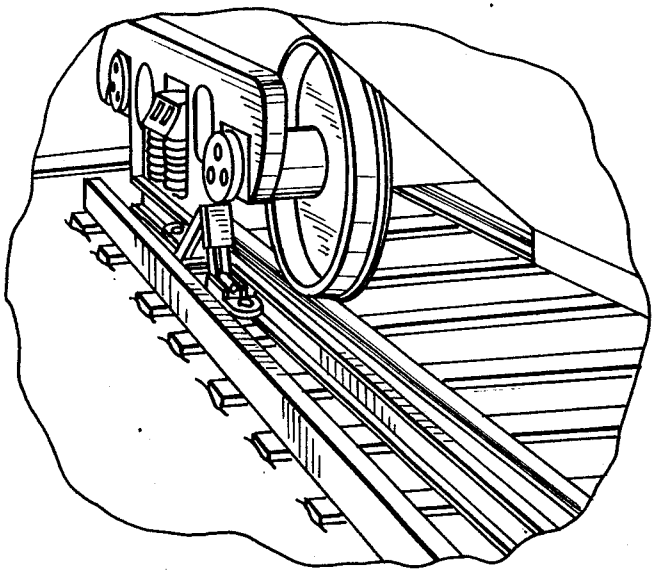
FIG. 5 is a perspective view illustrating a rail car being moved, showing the supporting tracks alongside the rail car tracks.

Referring to the drawings, there is shown a rail car moving system in accordance with the invention wherein like elements are referred to by the same reference characters. FIG. 1 illustrates a side view of the sytem in its non-use position. The system includes two identical moving carriages or trucks 10 supported by the same frame 12. Each of the trucks include a front section 14 including four front wheels, and a rear section 16 including four rear wheels. The wheel 18 are alike in which each wheel has an inner rim 20 with a sloping outer surface 22 which slopes toward the center of the wheel as shown in FIG. 4. As shown, the rear sections 16 of the trucks are adjacent each other. The wheels are supported by fixed axles 24 and use antifriction bearings for support which are well-known in the art. The front wheel sections 14 are secured to the frame so that they are fixed in place on the frame. The rear wheel sections 16 are slidably supported by the frame such that the rear section can be moved toward the front section. Strong springs 26 are provided on each side of the frame with one end connected to the fixed front end section and the other end connected to the movable rear end section. The front and rear sections of the trucks are secured together by use of two pairs of spaced pusher arms 28, 30 which are joined together at one end by a pivot rod 32 with the end of one pair of arms pivotably secured to the fixed front section by rod 33 and the other ends of the other pair of pusher arms are secured to the movable rear section and pivotable about rod 35. FIG. 2 illustrates the pairs of arms raised with the rear section pulled adjacent to the front section of the trucks. Each pair of arms are separated by a pusher plate 34 made of a suitable metal such as steel.

The strong springs have sufficient tension to pull the rear section toward the front section. In order to lower the pusher arms, a hydraulic cylinder 36 including a piston, not shown, with a rod extension 38, is provided. One end of the cylinder is pivotably secured about rod 37 secured to the frame of the fixed front section and the exposed end of the piston rod 38 is provided with a transverse rod 39 pivotable in a forked cradle 40 secured at one end of the pusher arm 28 by a bolt 41. When it is desired to lower the pusher arms, hydraulic fluid is applied to the cylinder 36 which forces the piston 38 toward the arm 28 and the rod 38 and transverse 39 forces the arms 28 and 30 to their recessed position.

The front section of each truck and the frame is provided with apertures 42, 44 through which a pin is passed to secure the end of a tow cables 46, 48 which tows the trucks in either direction.

Since one frame is used for each of the trucks, the trucks may be made in one place and assembled alongside the rail tracks with the frame. The movable assembly has an overall length of about 100 inches from tow bolt to tow bolt. The height in the recessed position is about 6 $\frac{7}{8}$ inches including the tracks in which the trucks move. As shown in FIG. 4, the wheels are guided in guide rails 50 which are shaped to the shape of the wheels. The rim 20 has a diameter of about 6″ and rides on a bottom plate 52 that is secured to the rail track ties by lag screws and the sloped face of the wheels ride on the guides 50. The guide rails are placed such that the moving system is centered about 12″ from the center of the track rail. The frame has a width of about 5″ and the width of the track is about 12″. The height of the pusher rails in the raised position is about 16″. Therefore, when the pusher is in its raised position the pusher will contact the side-frame of the rail car and push the car. When in the recessed position the car will pass over the mover assembly.

Figure 6:
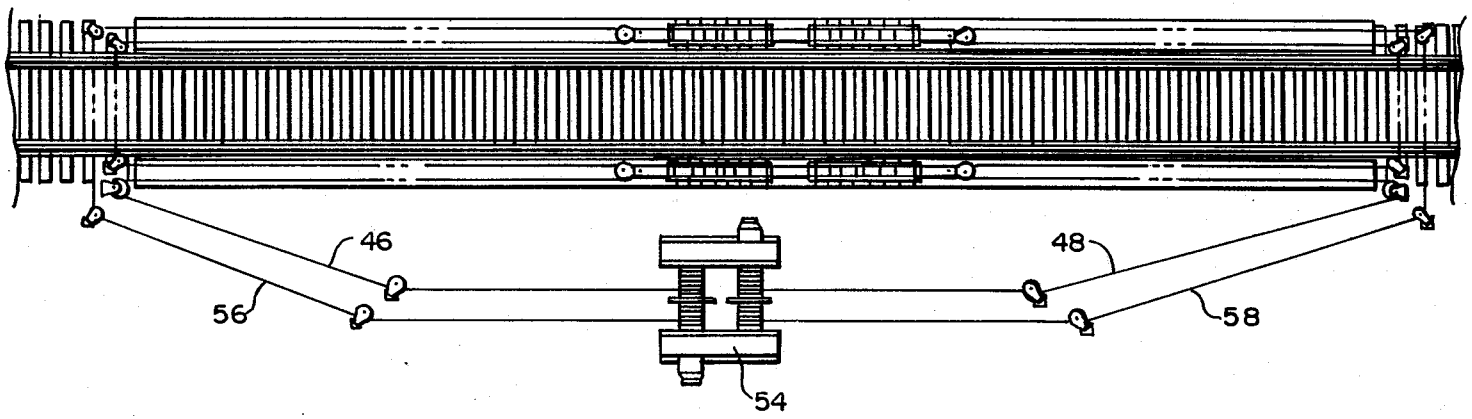
FIG. 6 illustrates a cable towing system.

A cable system such as shown in FIG. 6 may be used to tow the trucks. For light loads, only one moving truck assembly is necessary; however, for heavy loads a mover truck assembly may be used on each side of the rail car. Such a system is shown in FIG. 6. One end of one cable 46 is secured to one end of a double truck assembly and the end of another cable 48 is secured to the opposite end of the double truck assembly. The cables 46 and 48 are either fed out or rolled in by use of a double-divided drum winch 54. The mover truck assembly on the opposite side is towed by cables 56 and 58. If only one double truck assembly is used a divided drum would not be necessary but would require the double divided winch. Obviously, suitable pulleys would be required at the ends of the length of the double truck assembly track in order to move the double truck assembly the necessary distance. The length of the cable will depend on the length of the double truck assembly track. Since the cylinders 36 are hydraulically operated, a hydraulic motor-pump system and a feed line will be necessary for supplying the hydraulic fluid under pressure to the hydraulic cylinders. The hydraulic line will be pulled along with the double truck assembly for supplying the hydraulic fluid to the cylinders. The cylinders on each truck will operate simultaneously to raise the pusher arms. Each truck may be provided with a keeper hook which will hold the arms in their recessed position.

In operation, the car to be pushed is moved to the area of the track provided with the double truck assembly. The pusher arms are raised by releasing the keeper hook and/or pressure in the hydraulic cylinders so that the springs 26 will raise the pusher arms. Once the pusher arms have been raised, the double truck assembly is moved in the direction in which the rail car is to be pushed by use of the cable. As the lead truck approaches the rail car side frame, the raised pusher arm will strike the rail car side frame, as the double truck assembly moved further the leading pusher arm 28 will be forced downwardly carrying the pusher arm 30 with it. Since the piston rod of each hydraulic cylinder has been retracted, the arms will move freely to the recessed position below the rail car side frame and the lead truck will move beyond the rail car side frame where the arms 28 and 30 will be raised again by the springs 26. The pusher arm 30 of the rear truck will then contact the rail car side frame. Since the pusher arms 30 and 28 are pushed toward the hydraulic cylinder on the rear truck the pusher arms will not recess and the pusher arm 30 will then push the car. In operation, the front truck is the one in the direction in which the double truck assembly is to move or is moving. Thus, the front truck becomes the rear truck if moved in the opposite direction. The hydraulic pressure system and winch system are within the skill of a marker in the art and is believed not necessary to describe those systems in detail. The cables and hydraulic lines must be arranged so that they are not damaged by the rail car or the double truck assembly.

Since the hydraulic cylinder is on the front section of each truck and provides a stop means which prevents the pusher arms from being recessed, the pusher arms also act as a stop for the rail car. Since one set of pusher arms are in front of the side frame and one is behind the side frame the car cannot move in either direction with the arms of each truck raised.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A rail car moving system which comprises:

a guide track secured onto one end of rail track ties outside of and substantially parallel with supporting rails, at least one truck supported by wheels and movable relative to said guide track to push a rail car for a desired distance, said guide track having a configuration conducive to receiving said wheels of said at least one truck, said at least one truck including two pair of pusher arms, said pusher arms being adaptable to be recessed in a position lower than a side frame of a rail car and to be raised to an up position which engages said side frame of said rail car for pushing said rail car, and means for moving said at least one truck for pushing said rail car.

2. A rail car moving system as set forth in claim 1, which includes:

a frame, a pair of trucks secured end-to-end to the same frame in linear alignment.

3. A rail car moving system as set forth in claim 2, in which:

said pair of trucks includes a fixed front section secured to said frame and supported by two pair of wheels, and a rear section which is movable along said frame relative to said front section and supported by two pair of wheels.

4. A rail car moving system which comprises:

a frame, a pair of trucks secured end-to-end to the same frame in linear alignment and movable relative to a rail line to push a rail car for a desired distance, said pair of trucks includes a fixed front section secured to said frame and supported by two pair of wheels, a rear section which is movable along said frame relative to said front section and supported by two pair of wheels, each of said pair of trucks include two pair of pusher arms with each pair connected in a pivotable end-to-end relationship, said pusher arms being adaptable to be recessed in a position lower than a side frame of a rail car and to be raised to an up position which engages said side frame of said rail car for pushing said rail car, and means for moving said pair of trucks for pushing said rail car.

5. A rail car moving system as set forth in claim 4, in which each of said trucks include a hydraulic cylinder piston, said hydraulic cylinder-piston connected to one end of one pair of pusher arms of each truck for moving said pair of arms of each truck from a raised position to a recessed position.

6. A rail car moving system as set forth in claim 5, in which each of said trucks include spring means secured at one end to said fixed front section and secured at its opposite end to said movable rear section.

7. A rail car moving system as set forth in claim 6, in which said front section and said rear section of each of said trucks include a pair of springs with one end thereof connected thereto, said pair of springs having sufficient tension to raise said pusher arms into a raised position.

8. A rail car moving system as set forth in claim 5 which includes:

a hydraulic power source for applying hydraulic pressure to said hydraulic cylinder piston for lowering said pair of pusher arms from a raised position to a recessed position.

9. A rail car moving system as set forth in claim 2 which includes:

a cable-winch device for moving said at least one truck simultaneously for pushing a rail car on said supporting rails.

* * * * *